US006550192B1

(12) United States Patent
Nelson et al.

(10) Patent No.: US 6,550,192 B1
(45) Date of Patent: Apr. 22, 2003

(54) TRANSITION MOLDING

(76) Inventors: Richard C. Nelson, 312 Preakness La., Sneads Ferry, NC (US) 28460; Roger C. Jones, 151 Grace La., Richlands, NC (US) 28574

( * ) Notice: Subject to any disclaimer, the term of this patent is extended or adjusted under 35 U.S.C. 154(b) by 0 days.

(21) Appl. No.: 09/783,506

(22) Filed: Feb. 14, 2001

(51) Int. Cl.[7] ..... E04F 15/14

(52) U.S. Cl. ..... 52/177; 52/466; 52/716.1; 52/717.03; 52/718.01; 52/718.03; 16/4; 16/7

(58) Field of Search ..... 52/177, 179, 273, 52/461, 464, 466, 467, 716.1, 717.03, 717.04, 717.05, 717.06, 718.01, 718.03, 718.04; 16/4, 7, 16

(56) References Cited

U.S. PATENT DOCUMENTS

| | | | | | |
|---|---|---|---|---|---|
| 763,485 | A | * | 6/1904 | Haussler | 16/7 |
| 1,483,941 | A | * | 2/1924 | Kasson | 52/273 X |
| 1,576,527 | A | | 3/1926 | McBride | |
| 1,592,923 | A | * | 7/1926 | Butterworth | 16/7 |
| 1,769,283 | A | | 7/1930 | Awbrey | |
| 1,959,991 | A | * | 5/1934 | Vaughan | 52/716.1 |
| 1,966,020 | A | | 7/1934 | Rowley | |
| 2,258,314 | A | | 10/1941 | Bonnell | |
| 2,449,904 | A | | 9/1948 | Lorraine | |
| 2,506,030 | A | * | 5/1950 | Mapes | 16/7 |
| 2,644,977 | A | | 7/1953 | June | |
| 2,875,467 | A | * | 3/1959 | De Vault | 16/7 |
| 2,980,943 | A | | 4/1961 | Barnes et al. | |
| 2,996,751 | A | | 8/1961 | Roby et al. | |
| 3,254,361 | A | | 6/1966 | Brunn et al. | |
| 3,528,122 | A | | 9/1970 | Fuller et al. | |
| 3,543,326 | A | * | 12/1970 | Rohrberg et al. | 16/16 |
| 3,667,177 | A | | 6/1972 | Biela | |
| 4,054,698 | A | | 10/1977 | Hamrah | |
| 4,321,294 | A | * | 3/1982 | Naka | 52/179 X |
| 4,653,138 | A | * | 3/1987 | Carder | 16/4 |
| 4,893,449 | A | | 1/1990 | Kemper | |
| 5,581,967 | A | * | 12/1996 | Glatz | 52/465 |
| 5,657,598 | A | * | 8/1997 | Wilbs et al. | 52/464 X |
| 5,706,623 | A | | 1/1998 | Brown | |
| 5,756,176 | A | | 5/1998 | Feld | |
| 5,766,726 | A | | 6/1998 | Bannister | |
| 6,038,733 | A | | 3/2000 | Carder et al. | |
| 6,047,506 | A | * | 4/2000 | Kemper | 52/179 |
| 6,115,982 | A | * | 9/2000 | Lindenberg | 52/718.04 X |
| 6,345,480 | B1 | * | 2/2002 | Kemper et al. | 52/717.03 X |

FOREIGN PATENT DOCUMENTS

| | | | |
|---|---|---|---|
| DE | 296 00 057 | * | 4/1996 |
| WO | WO 99/01628 | * | 1/1999 |

* cited by examiner

*Primary Examiner*—Laura A. Callo

(57) ABSTRACT

Molding systems are described that include molding strips releasibly insertable into a mounting strip or track. The molding systems act as a transition between tile, both with and without backerboard support, and a floor or various floor coverings, including carpet, or wood flooring. Other molding systems are used to form a transition between tile, with or without backerboard and door threshold plates. In another embodiment, a molding system is provided for covering an edging strip used to secure the edge of a carpet.

14 Claims, 7 Drawing Sheets

TRANSITION MOLDING

BACKGROUND OF THE INVENTION (1) Field of the Invention

The present invention relates generally to molding, and in particular to molding systems positionable between different floor coverings.

(2) Description of the Prior Art

Commercial and residential building floors are commonly covered with different types of surfacing materials, depending on how the particular area of a building is to be used, and upon the aesthetics desired. Common floor covering materials include carpeting, tile, wood and vinyl. These floor coverings may be applied directly to the building floor, or an intermediate surfacing material may be used between the floor covering and the floor.

For example, tile may be adhered directly to a concrete floor. However, if tile is used to surface a wood floor, an intermediate layer of a material known as backerboard is first laid over the wooden subfloor, and the tile is adhered to the upper surface of the backerboard. Carpet may also be adhered directly to a floor, or a pad may be placed between the floor and the carpet.

Floors of many building are covered with more that one type of floor covering, since different sections of the floor may be subjected to different condition, or it may be desirable aesthetically to provide different surfaces in different areas of the building. When the edge of a particular floor covering abuts a building wall, the common practice is to install a molding strip along the wall at the intersection of the wall and the floor covering. This molding strip serves to cover the floor covering and wall interface, which improved the appearance, and also prevents debris from entering the space between the wall and the floor covering.

The edges of floor coverings such as wood flooring, vinyl (sometimes called linoleum), ceramic tile, and so-called "glue down" carpeting, are normally held in place with adhesive. The edge of other carpeting, usually including a pad, is held in place against a wall with a tack strip.

Floor coverings may also terminate in areas other that along a wall. For example, a given floor covering material may terminate within a room at some point between walls, or within a doorway. Also, the edge of one type of floor covering may abut the edge of another type of floor covering. For example, the edge of carpeting may terminate at a location between walls with the adjacent floor being without a floor covering, e.g., a concrete floor, or covered by a different type of floor covering, such as vinyl, or a wood flooring that continues beneath the carpet. If so, the carpet will be installed over a part of the wood flooring.

Generally, floor coverings of this type provide a smooth transition between the two type of surfaces, since the surfaces are approximately of the same height. However, a problem arises when one of the floor coverings is tile, such as ceramic tile, due to the thickness or height of the tile relative to the thickness or height of the other floor coverings. Due to the difference in height between the tile and the other flooring, the edge of the tile is exposed, creating an unsightly appearance. This is particularly true if the tile is mounted on backerboard, which increases the height of the tile relative to the other floor covering. Currently, there is no satisfactory means for eliminating this unsightly appearance.

A similar unsightly appearance is created when tile, with or without underlying backerboard, terminates adjacent a doorway threshold plate, i.e., the wooden strip that extends along the bottom of a door facing. While the threshold plate may be of a similar height, the threshold edge is often of a slanted or curved profile, while the tile have a vertical edge. As a result, there is the appearance of a gap between the tile and the threshold, which is not only unsightly, but which collects debris.

In other instances, when a carpet terminates at a location other than adjacent a wall, the edge of the carpet is often secured in place by a metal tacking strip or carpet edging strip that is includes a bottom plate, which is secured to the floor. The bottom plate normally includes upwardly extending projections or teeth that grip the lower surface of the carpet. An integral top plate extends rearwardly from the bottom plate, and can be folded over the carpet edge and against the top edge of the carpet in order to protect the carpet edge. The carpet edging strip, which is commonly of metal, is functional, but also unsightly.

Thus, there is a continuing need for means to improve the appearance of floor coverings. In particular, there is a need to provide an aesthetically pleasing transition between tile and floors or floor coverings. There is also a need to provide for a transition between tile and a doorway threshold. Finally, there is a need to improve the appearance of carpet edging strips used to secure the edge of carpets at locations away from walls.

SUMMARY OF THE INVENTION

The present invention is directed to molding systems for improving the appearance of the edges of floor coverings. Each molding system described herein is comprised of a molding strip having a particular profile, and a mounting strip to releasibly attach the molding strip to the floor.

In one embodiment, molding systems are provided for covering the interface between tile, whether or not on backerboard, and the floor upon which the tile is mounted, or an adjacent floor covering. Generally, this ceramic tile molding system is comprised of a molding strip including an upper cap or surface that has parallel outer edges, and a first side that is adapted to fit against the edge of ceramic tile and extend over the top of the tile edge. The tile attachment side has a first vertical face with upper an lower edges that is of a length up to the thickness or height of the tile and any backerboard. The cap extends outwardly to form an upper flange that extends over the tile upper edge. The lower surface of the flange is in the form of a horizontal face that abuts the tile upper surface when the molding strip is installed.

The molding strip also includes first and second lower surfaces that are separated by a vertical slot used to releasibly secure the molding strip to a mounting strip. The slot is parallel to the first vertical face and spaced at a given distance from said first face.

If the tile terminates adjacent another floor covering, the molding strip may also include a second covering attachment side on the opposite side of the molding strip from the first covering attachment side. The second attachment side may include a second vertical face to abut the edge of the other floor covering. The length or height of the second vertical face may be different from the length of height of the first vertical wall, and will generally be the same as, or less than, the thickness or height of the other floor covering material. The second vertical face may extend downwardly from the second edge of the top surface.

The upper surface of the molding section may be of various configurations, depending on the adjacent floor coverings, and the aesthetic appearance desired. For example, the surface may have an upwardly curved or convex profile. Alternatively, the upper surface can include a horizontal center section, a first outer section extending outwardly and downwardly from one side of the center section to the first edge, and a second outer section extending outwardly and downwardly from the other side of the center section to the second edge.

The molding strip is releasibly attached to the floor with a mounting strip that includes a trough for receiving a part of the molding strip. For example, the mounting track can include a horizontal base with outer parallel edges, and arms extending upwardly from the base edges. The arms are preferably flexible and inclined slightly inwardly, e.g., at up to about a 10° from vertical, when in the unflexed state.

When a portion of the molding strip is inserted between the arms, the arms are flexed outwardly, thereby exerting pressure against the sides of the inserted molding strip portion to secure the molding strip in position. For example, the mounting strip can include a trough that has a bottom wall with a width approximately equal to the distance between the slot and the first face of the molding strip described above. With this configuration, one of the arms in insertable into the slot and the other of the arms in positionable along the first face.

In order to adjust for thickness variations and uneven floors, the extent to which the molding strip portion is inserted between the arms can be varied. Moreover, the first and second lower surface can be in different horizontal planes, with the plane of the first surface, i.e., the surface between the slot and the first edge, being in a plane above the plane of the second surface. Thus, the second surface will abut the floor even when the first surface is spaced above the bottom of the mounting strip.

When the tile molding system is used, the mounting strip is secured to the floor alongside the vertical edge of the tile. For example screws or other fasteners can be inserted into the floor through holes in the bottom wall of the mounting strip. A lower portion of the molding strip, e.g., the portion between the first face and the slot, is then inserted into the mounting strip trough until the molding strip contacts the upper surface of the tile. If the tile is mounted on backerboard, a longer molding strip lower portion will be needed to extend downwardly for insertion into the mounting strip in order to ensure adequate fricitional engagement between the molding strip and the mounting strip.

If the edge of the tile terminates against the floor with no adjacent floor covering, the molding strip will be designed so that the upper surface extends downwardly to the floor, with the second edge abutting the floor when the molding strip is in place. If the edge of the tile is to be adjacent another floor covering, e.g., carpet, vinyl or wood flooring, the molding strip to be used will also include a second vertical face on the opposite side of the molding strip from the first edge. This second vertical face will generally be of a thickness or height at least equal to the thickness or height of the second floor covering. This second vertical face will extend downwardly from the second edge of the molding strip. Again, the second lower surface can be in a lower plane than the first lower surface to ensure that the second lower surface abuts against the floor.

The molding system used to cover the interface between tile and a door threshold plate is of a similar configuration, except that the face of the molding strip that is toward the threshold plate further includes an upper flange that extends over the intersection between the tile and the threshold, and into engagement with the threshold upper surface. More specifically, the molding strip of the threshold molding system includes, like the above-described molding strip, an upper surface with parallel first and second edges; and a first tile attachment side that has a first vertical face with upper an lower edges, and a first horizontal upper face extending from the upper edge of the first vertical face to said first edge.

This molding strip also includes an opposed threshold attachment side that has a second generally vertical face with upper and lower edges, and a second upper face extending from the upper edge of the second vertical face to the second edge. This second upper face can be inclined upwardly towards the second edge to generally conform to the shape of the threshold plate. Like the previous molding strip, the upper surface of the molding strip can be curved or of other profiles. For example, the upper surface can include a horizontal planar segment extending inwardly from the first edge, and a downwardly curved segment extending from the planar segment to second edge.

This molding system configuration also includes a mounting track having a trough for slidably receiving a part of the molding strip, which can be formed of a horizontal base with outer parallel edges, the arms extending upwardly from the edges, the arms being flexible and inclined slightly inwardly when in the unflexed state. The trough can have a bottom wall with a width approximately equal to distance between the first and second faces, whereby one of the arms is positionable along the first face, and the other arm is positionable along the second face.

To install the threshold molding system, the mounting strip is secured alongside the threshold plate, and the ceramic tile is installed abutting the opposite side of the mounting strip. The lower portion of the molding strip is then inserted between the upright arms of the mounting strip and pressed downwardly until the lower surface of the flange on the first side engages the top of the tile and the lower surface of the flange on the second side engages the top of the threshold plate. As a result, a smooth surface defined by the upper surface of the molding strip covers the transition between the tile and the threshold plate, providing a pleasing appearance, and preventing debris from collection in the intersection.

The third embodiment of the invention relates to a molding system to cover carpet edging strips along the edge of a carpet, and is specifically designed to be attached to previously installed edging strips, so that the edge trim does not need to be replaced in order to provide a pleasing appearance. The type of edging strips especially contemplated by the invention is of the type described above and is comprised of a bottom plate that is attached to the floor beneath the carpet edge and includes projections to engage the lower carpet surface, and an integral top plate that extends from the rear edge of the bottom plate and is foldable over the carpet edge to engage the upper surface of the carpet edge.

The edge molding system of the invention is designed to attach to and cover the existing carpet edging strip. The molding system used for this purpose is comprised of a molding strip that includes an upper surface with parallel first and second edges, and a lower surface. At least one track-receiving slot extends upwardly from the lower surface between said edges. The molding strip can extend downwardly to the floor, while the second edge extends downwardly to the upper surface of the carpet. The molding strip can also have a concave lower surface to conform to the upper surface of the top plate.

The mounting strip includes a mounting track that is positionable above the carpet edging strip for releasibly attaching the molding strip over the carpeting edge, and a means for securing the mounting strip to the edging strip. For example, the mounting strip can include a lower horizontal plate that is insertable beneath the edging strip, and an upper plate positionable above the edging strip when the lower plate is beneath the strip, with the molding strip attachment member extending upwardly from the second plate.

Preferably, the molding strip includes two parallel slots and the mounting track includes two attachment members, with the attachment members being insertable into the slots. The attachment attachment members are flexible and inclined slightly inwardly when in the unflexed state for the reasons noted above.

When used to cover the edge of an installed carpet that is secured in place with an edging strip, the bottom plate of the mounting strip is pushed beneath the edging strip to secure the mounting strip in place, and to position the upper surface of the mounting strip above the edging strip with the attachment arm or arms extending upwardly. The molding strip is then mounted onto the mounting strip with one side of the molding strip extending into engagement with the upper surface of the carpet, and the other side of the molding strip extending over the outer edge of the edging strip, and preferably into engagement with the floor.

Preferably, the molding strip is made of wood or other rigid material, with wood being preferred for aesthetic purposes. The mounting strip can be formed of metal or plastic.

DETAILED DESCRIPTION OF THE INVENTION

Figure 1:
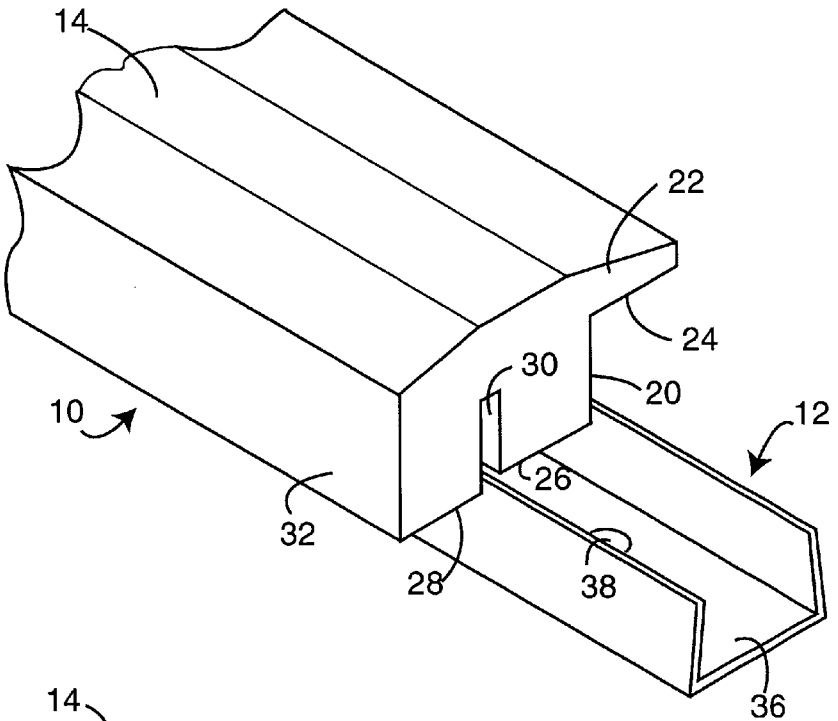
FIG. 1 is an exploded perspective view of a molding system used as the transition between tile on backerboard and carpet.
Figure 2:
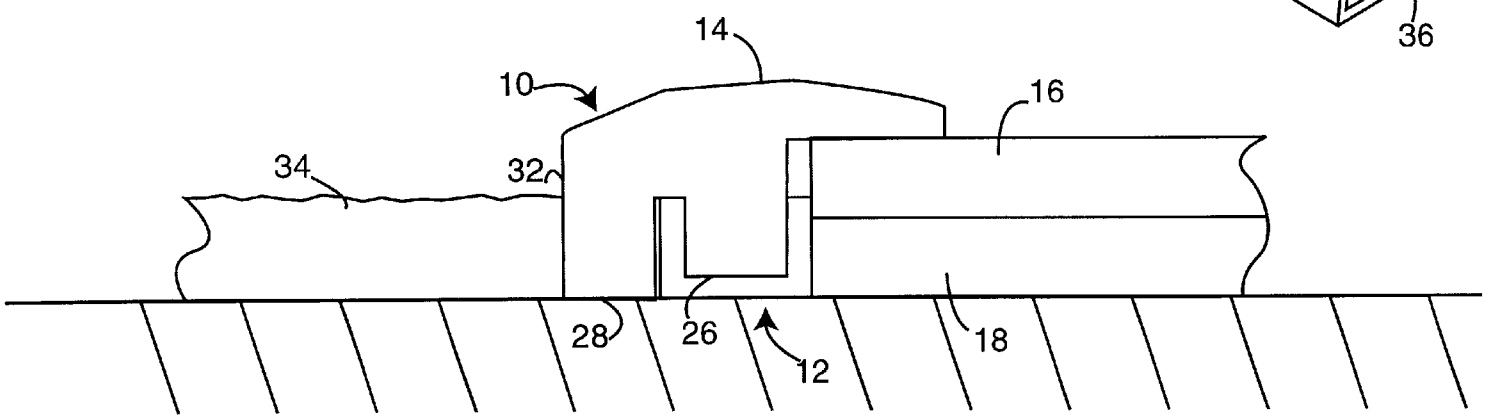
FIG. 2 is an end view of the molding system of FIG. 1, positioned between tile on backerboard and carpet.

FIGS. 1 and 2 illustrate a molding system comprised of molding strip, generally 10, and mounting strip, generally 12, for forming a transition between a tile floor covering laid on backerboard, and a carpet. Molding system 10 includes an upper cap 14 with parallel outer edges, a first side adapted to fit against the edge of tile 16 and backerboard 18, and to extend over the top edge of the tile 16. The tile attachment side has a first vertical face 20. Cap 14 extends outwardly to form an upper flange 22 with a horizontal lower 24 face to engage tile 16. Molding strip 10 also includes first and second lower surfaces 26 and 28, respectively, that are separated by vertical slot 30, used to releasibly secure strip 10 to mounting strip 12. Slot 30 is parallel to the face 20 and spaced at a given distance from said first face. Molding strip 10 also includes side 32 abutting the edge of carpet 34.

Molding strip 10 is releasibly attached to the floor with mounting strip 12 that includes a trough formed of horizontal base 36 and upwardly extending arms. Strip 10 is secured to the floor with fasteners 38.

Figure 3:
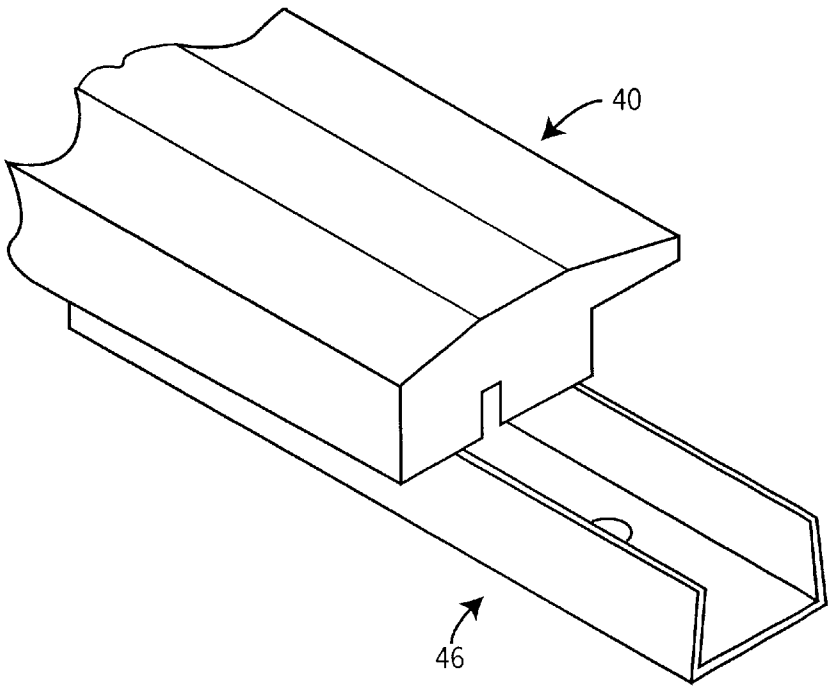
FIG. 3 is an exploded perspective view of a molding system used as the transition between tile without backerboard and carpet.
Figure 4:
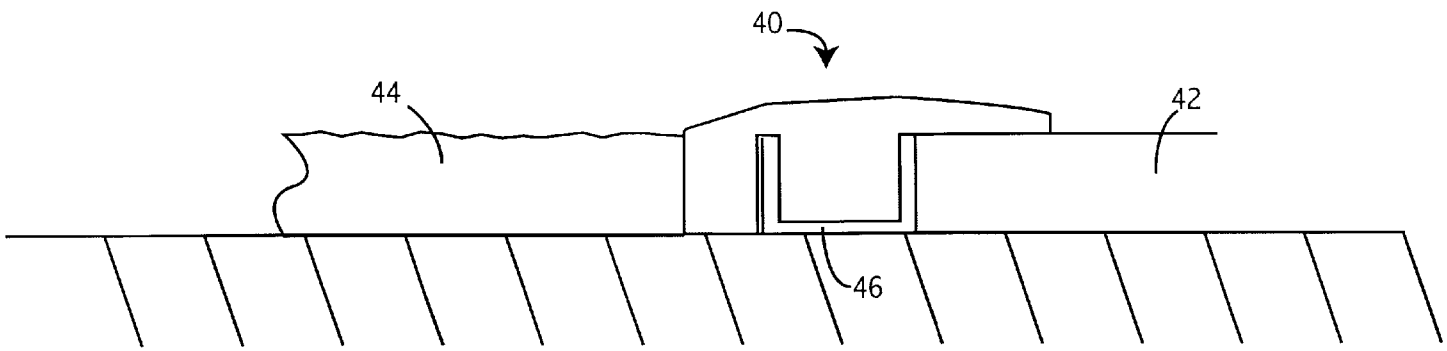
FIG. 4 is an end view of the molding system of FIG. 3, positioned between tile without backerboard and carpet.

FIGS. 3 and 4 illustrate the same type of molding system as the system illustrated in FIGS. 1 and 2, except that molding strip 40 is sized for use as a transition between tile 42, which is adhered to the floor without an intermediate backerboard, and carpet 44. Mounting strip 46 is generally of the same construction as strip 12.

Figure 5:
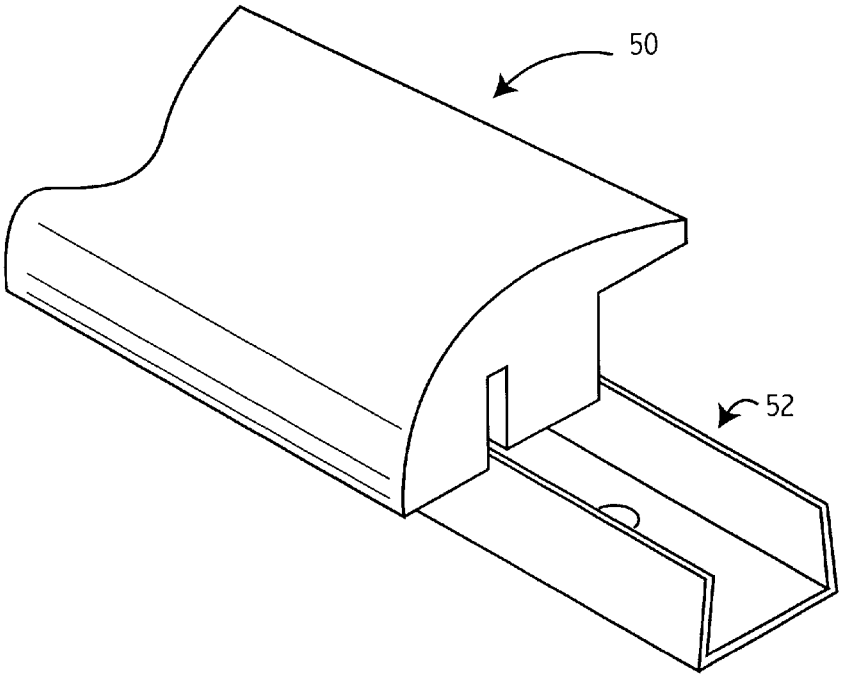
FIG. 5 is an exploded perspective view of a molding system used as the transition between tile on backerboard and a floor without covering.
Figure 6:
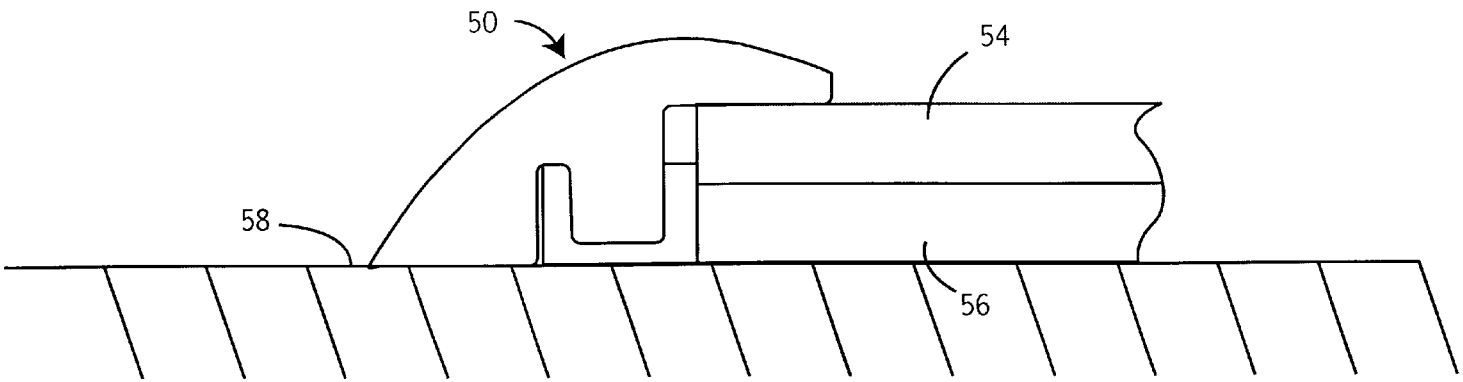
FIG. 6 is an end view of the molding system of FIG. 5, positioned between tile on backerboard and a floor without covering.

FIGS. 5 and 6 illustrate a molding system comprised of a molding strip, generally 50, and a mounting strip, generally 52, for forming a transition between a tile floor covering 54 laid on backerboard 56, and a floor or vinyl floor covering 58. Molding strip 50 is constructed similar to molding strip 10, except that the edge of upper cap 60 extends downwardly to the top of the floor or vinyl floor covering 58. Molding strip 50 is releasibly attached to the floor with mounting strip 62, which is of the same construction as molding strip 12.

Figure 7:
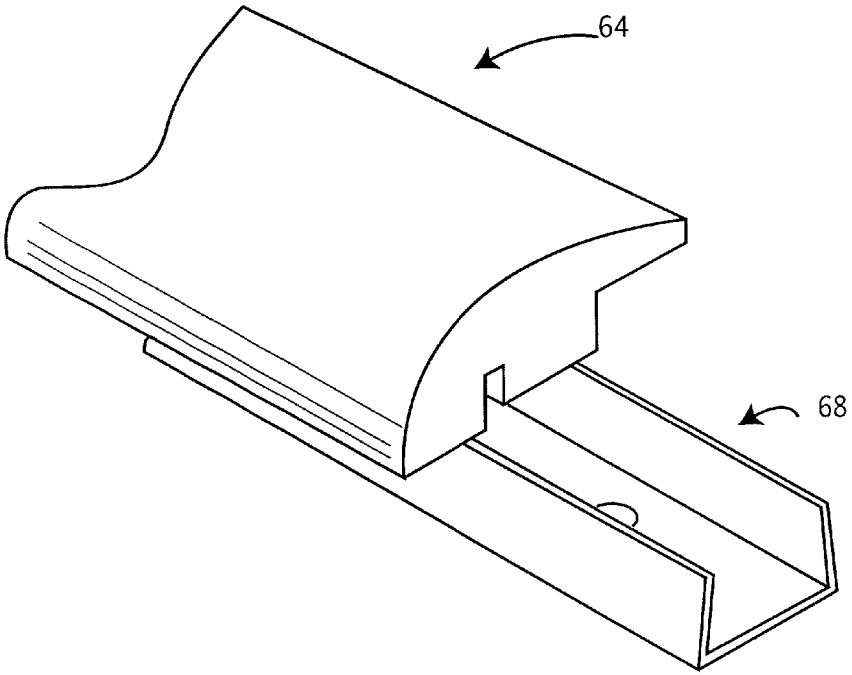
FIG. 7 is an exploded perspective view of a molding system used as the transition between tile without backerboard and a floor without covering.
Figure 8:
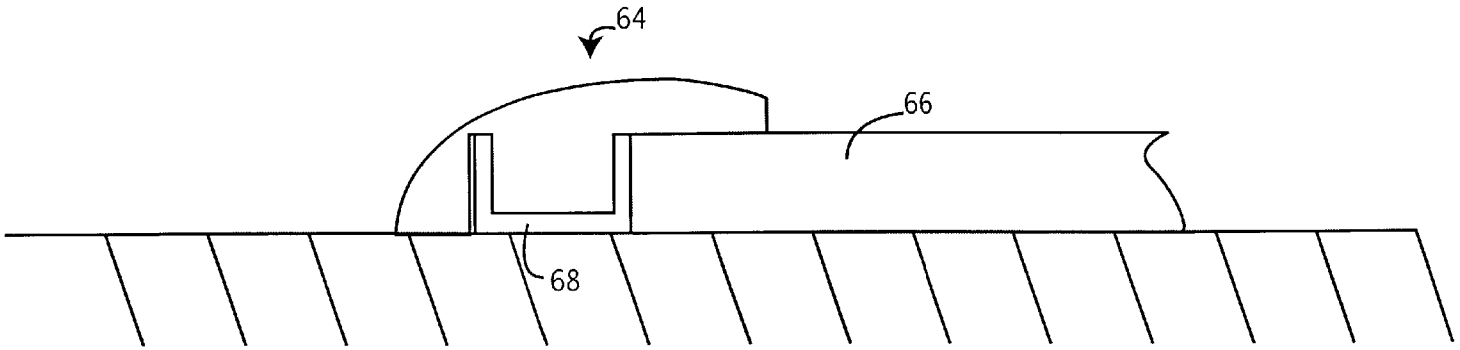
FIG. 8 is an end view of the molding system of FIG. 7, positioned between tile without backerboard and a floor without covering.

FIGS. 7 and 8 illustrate the same type of molding system as is illustrated in FIGS. 5 and 6, except that molding strip 64 is sized for use with tile 66, which is adhered to the floor without an intermediate backerboard. Mounting strip 68 is generally of the same construction as strips 12 and 52.

Figure 9:
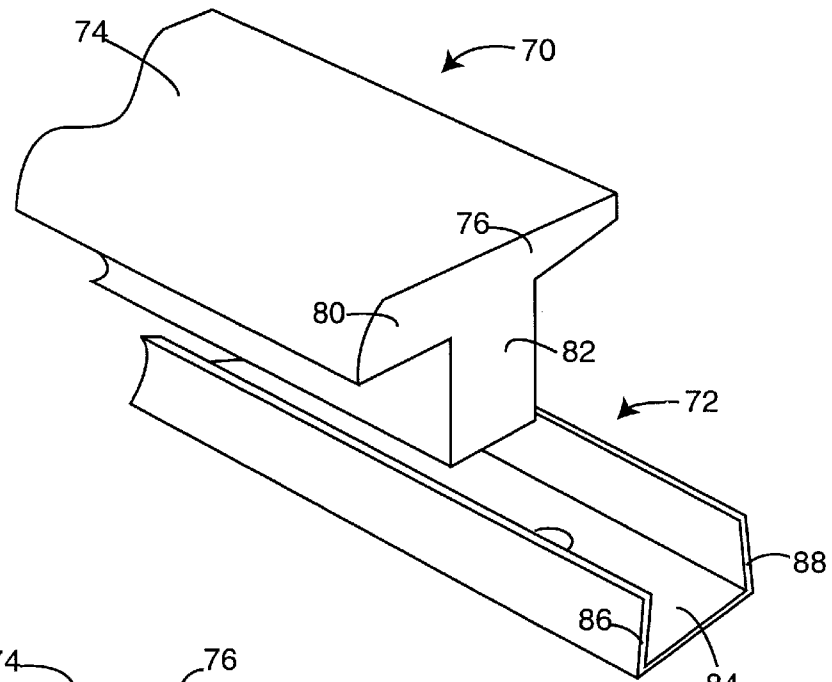
FIG. 9 is an exploded perspective view of a molding system used as the transition between tile on backerboard and a door threshold plate.
Figure 10:
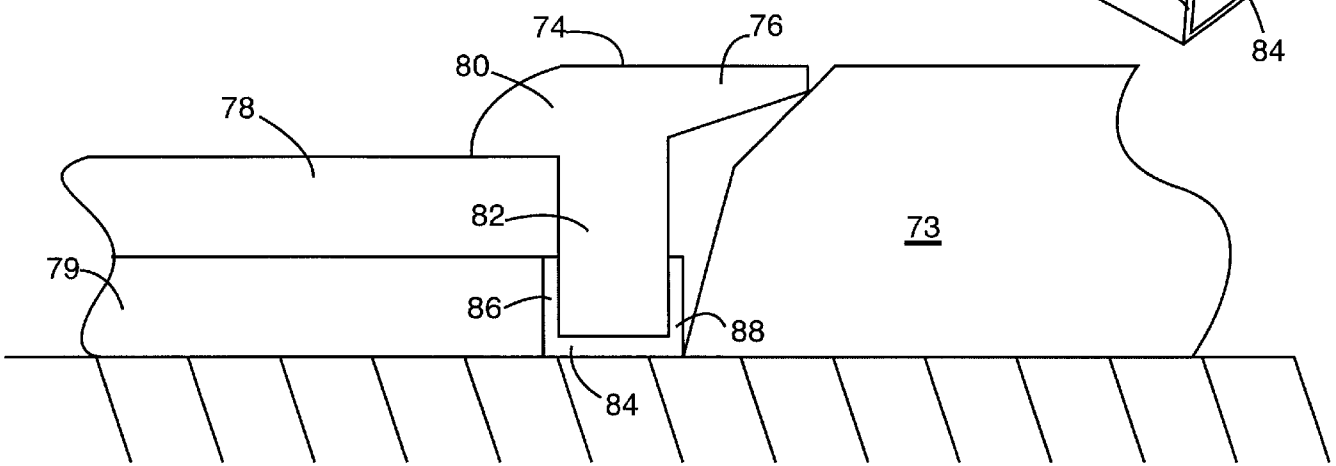
FIG. 10 is an end view of the molding system of FIG. 9, positioned between tile on backerboard and a door threshold plate.

FIGS. 9 and 10 illustrate a molding system comprised of a molding strip, generally 70, and a mounting strip, generally 72, for forming a transition between a tile floor covering laid on backerboard, and door threshold plate 73. Molding strip 70 includes an upper cap 74 with parallel outer edges, a horizontal planar segment extending inwardly from a first edge, and a downwardly curved segment extending from the planar segment to a second edge, and a first flange 76 adapted to fit over tile 78 and backerboard 79. A second flange 80 extends over and into engagement with the upper surface of threshold plate 73. Molding strip 70 also includes lower foot 82 that is releasibly insertable into mounting strip 72. Strip 72 is configured like the above mounting strips, and includes a trough formed of horizontal base 84 and upwardly extending arms 86 and 88.

Figure 11:
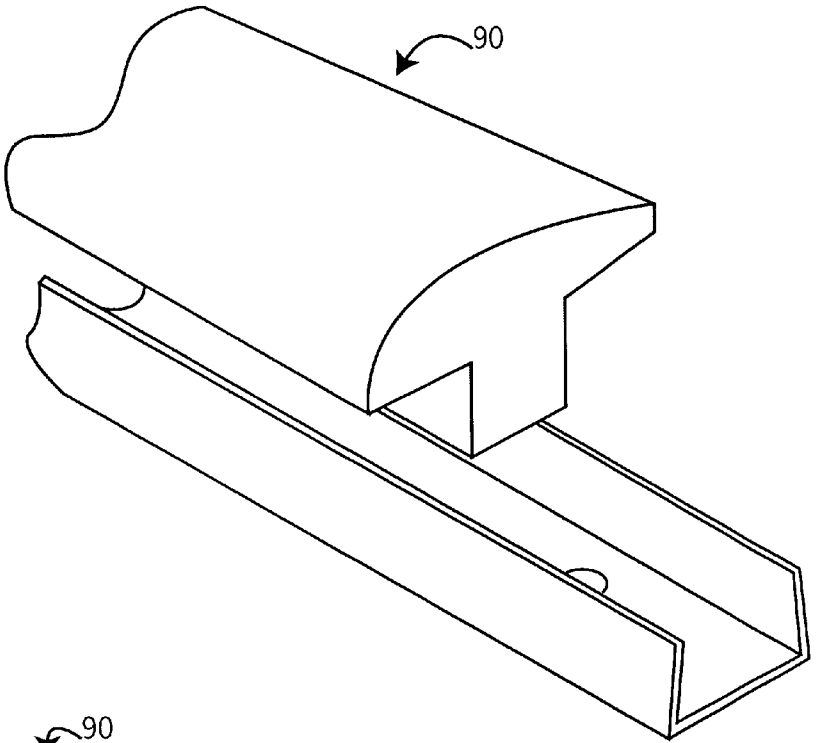
FIG. 11 is an exploded perspective view of a molding system used as the transition between tile without backerboard and a door threshold plate.
Figure 12:
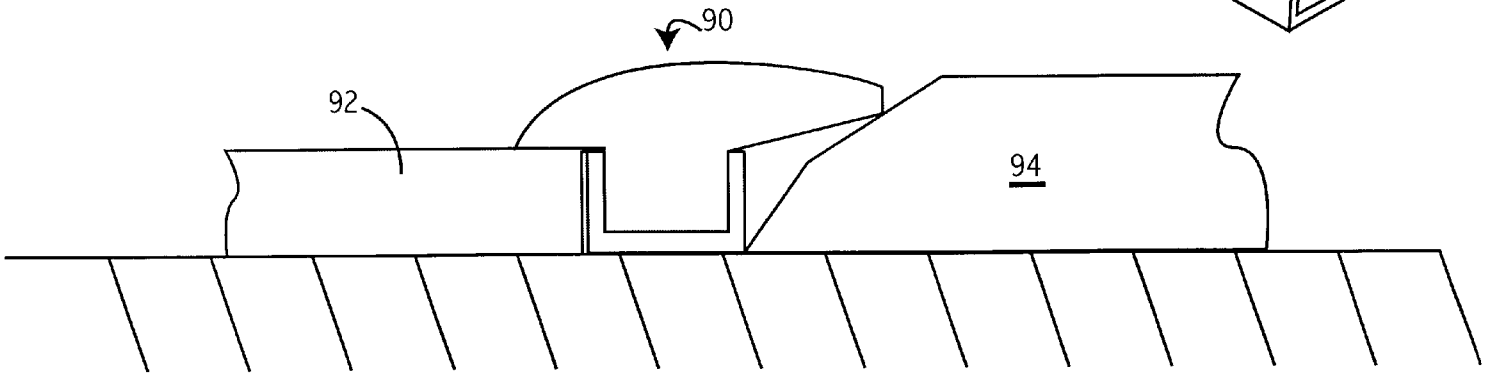
FIG. 12 is an end view of the molding system of FIG. 11, positioned between tile without backerboard and a door threshold.

FIGS. 11 and 12 illustrate the same type of molding system as the system illustrated in FIGS. 9 and 10, except that molding strip 90 is sized for use as a transition between tile 92, which is adhered to the floor without an intermediate backerboard, and threshold plate 94.

Figure 13:
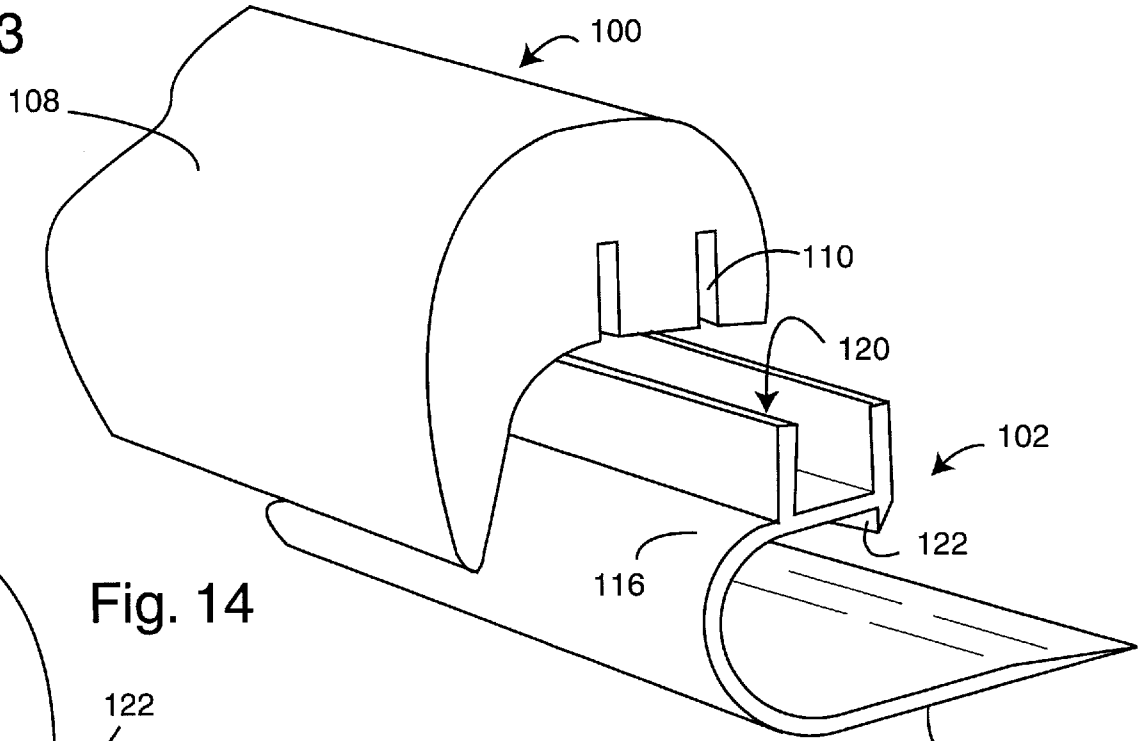
FIG. 13 is an exploded perspective view of a molding system used to cover a carpet edging strip.
Figure 14:
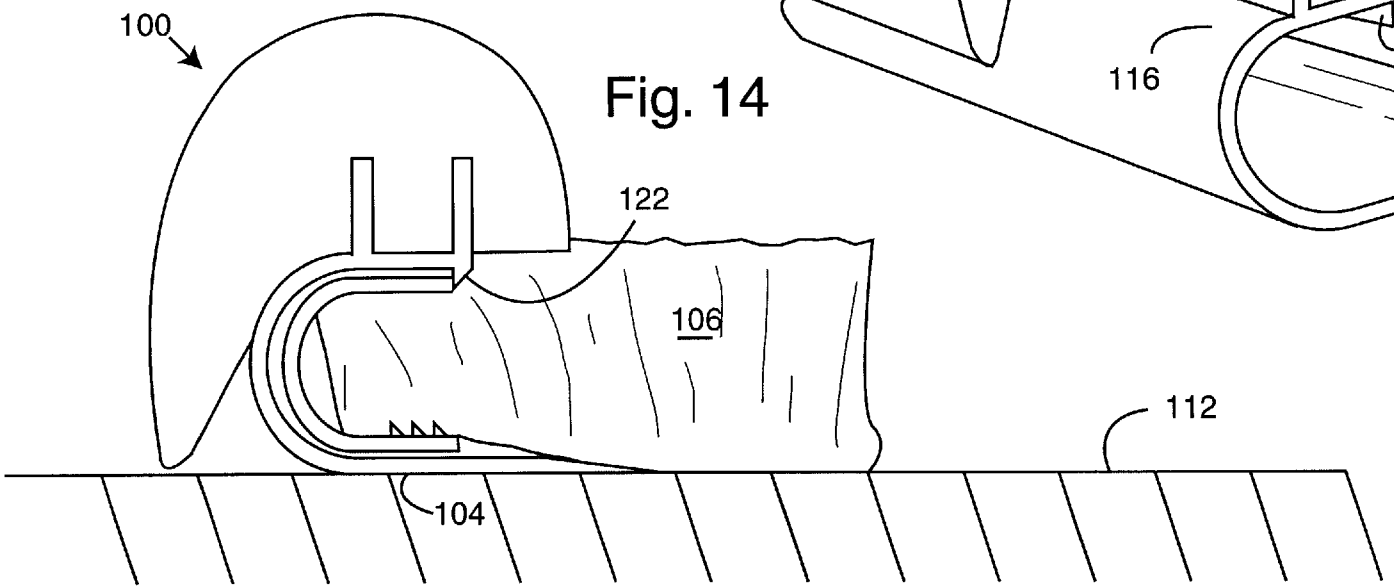
FIG. 14 is an end view of the molding system of FIG. 1, positioned to cover a carpet edging strip.

FIGS. 13 and 14 illustrate a molding system comprised of molding strip, generally 100, and mounting strip, generally 102, for covering carpet edging strip 104 used to secure the edge of carpet 106. Molding strip 100 includes an upper cap 108 with parallel outer edges, and a lower surface. Track-receiving slots 110 extend upwardly from the lower surface between the edges. Molding strip 100 can extend downwardly to floor 112, while the second edge extends downwardly to the upper surface of carpet 106. Molding strip 100 can also have a concave lower surface to conform to the upper surface of edging strip 104.

Mounting strip 102 includes an upper plate 116 positionable above edging strip 104 and a lower plate 118 positionable beneath strip 104. Molding strip mounting member 120 extends upwardly from the upper surface of upper plate 116. Plates 116 and 118 are integrally formed from a single sheet that is curved around the rear edge of edging strip 104. Mounting member 120 may be in the form of a trough with upwardly extending arms for insertion into slots in the lower surface of molding strip 100. A locking member 122, integral to upper plate 116 extends downward from upper plate 116 to engage a carpet edging strip when mounting member 102 is inserted over the edging strip.

Certain modifications and improvements will occur to those skilled in the art upon a reading of the foregoing description. It should be understood that all such modifications and improvements have been deleted herein for the sake of conciseness and readability but are properly within the scope of the follow claims.

What is claimed is:

1. A molding system positionable between the edges of floor coverings and a door threshold plate comprising:

a) a molding strip including an upper surface with parallel first and second edges; a first covering attachment side having a first flange positionable over said floor covering; and an opposed flange having an upwardly inclined lower wall, said flange being positionable over said threshold plate; and b) a mounting track having a trough with arms for slidably receiving a part of said molding strip, said mounting track includes a horizontal base with outer parallel edges, said arms extending upwardly from said edges, said arm being flexible and inclined slightly inwardly when in the unflexed state.

2. The molding segment of claim 1, wherein said upper surface includes a horizontal planar segment extending inwardly from said first edge, and a downwardly curved segment extending from said planar segment to said second edge.

3. A molding system for covering a carpet edging strip securing a carpet edge to a floor comprising:

a) a molding strip including an upper surface with parallel first and second edges and a lower surface, said first edge adapted to extend downwardly to the floor, and said second edge adapted to extend downwardly to the carpet, said lower surface configured for attachment to a mounting member; and b) a mounting strip including an attachment member positionable above said carpet edge for releasibly attaching said molding strip over said edging strip.

4. The molding system of claim 3, wherein said mounting strip includes a lower horizontal plate insertable beneath said edging strip, an upper plate positioned above said edging strip when said lower plate is beneath said strip, said attachment member extending upwardly from said upper plate for releasable attachment to said molding strip.

5. The molding system of claim 4, wherein said molding strip includes two parallel slots and said mounting strip includes two attachment members, said attachment members being insertable into said slots.

6. The molding system of claim 5, wherein said attachment members are flexible and inclined slightly inwardly when in the unflexed state.

7. The molding system of claim 3, wherein said molding strip has a concave lower surface.

8. A molding system for covering a carpet edging strip securing a carpet edge to a floor comprising:

a) a molding strip including an upper surface with parallel first and second edges and a lower surface, said strip having a lower surface configured for attachment to a mounting member; and b) a mounting strip including a lower plate insertable beneath said edging strip, an upper plate integral with said lower plate adapted to be positioned above said edging strip when said lower plate is beneath said edging strip, and an attachment member extending upwardly from said upper plate for releasable attachment to said molding strip, said mounting strip including a locking member extending downward from said upper plate to engage said carpet edging strip when said mounting strip is inserted over said edging strip.

9. The molding system of claim 8, wherein said molding strip first edge is adapted to extend downwardly to said floor, and said second edge is adapted to extend downwardly to said carpet.

10. The molding system of claim 8, wherein said molding strip includes two parallel slots and said mounting track includes two attachment members, said attachment members being insertable into said slots.

11. The molding system of claim 10, wherein said attachment members are flexible and inclined slightly inwardly when in the unflexed state.

12. The molding system of claim 8, wherein said molding strip has a concave lower surface.

13. The molding system of claim 8, wherein said upper and lower plates are formed from a single sheet of material that curves around said carpet edging strip when said mounting member is inserted over said edging strip.

14. A molding system positionable between the edges of floor coverings and a door threshold plate comprising:

a) a molding strip including an upper surface with parallel first and second edges, a horizontal planar segment extending inwardly from said first edge, and a downwardly curved segment extending from said planar segment to said second edge; a first covering attachment side having a first flange positionable over said floor covering; and an opposed flange having an upwardly inclined lower wall, said flange being positionable over said threshold plate; and b) a mounting strip having a trough with arms for slidably receiving a part of said molding strip, said mounting track includes a horizontal base with outer parallel edges, said arms extending upwardly from said edges.

* * * * *